US006458261B2

(12) United States Patent
Castegnier et al.

(10) Patent No.: US 6,458,261 B2
(45) Date of Patent: Oct. 1, 2002

(54) ELECTROCOAGULATION PRINTING METHOD AND APPARATUS PROVIDING ENHANCED IMAGE RESOLUTION

(75) Inventors: Adrien Castegnier, Outremont (CA); Guy Castegnier, Iles des Soeurs (CA)

(73) Assignee: Elcorsy Technology Inc., Saint-Laurent (CA)

( * ) Notice: Subject to any disclaimer, the term of this patent is extended or adjusted under 35 U.S.C. 154(b) by 0 days.

(21) Appl. No.: 09/774,059

(22) Filed: Jan. 31, 2001

Related U.S. Application Data

(63) Continuation-in-part of application No. 09/430,020, filed on Oct. 29, 1999, now Pat. No. 6,210,553.

(51) Int. Cl.[7] ..... C25D 13/04

(52) U.S. Cl. ..... 204/486; 204/483; 204/508; 204/623; 101/DIG. 29

(58) Field of Search ..... 20/486, 483, 508, 20/623; 101/DIG. 29

(56) References Cited

U.S. PATENT DOCUMENTS

| | | | | |
|---|---|---|---|---|
| 4,661,222 A | | 4/1987 | Castegnier | 204/180.9 |
| 4,895,629 A | | 1/1990 | Castegnier et al. | 204/180.9 |
| 5,538,601 A | | 7/1996 | Castegnier | 204/486 |
| 5,750,593 A | | 5/1998 | Castegnier et al. | 523/161 |
| 5,908,541 A | | 6/1999 | Castegnier | 204/486 |
| 6,210,553 B1 | * | 4/2001 | Castegnier | 204/486 |

* cited by examiner

*Primary Examiner*—Kishor Mayekar
(74) *Attorney, Agent, or Firm*—Ogilvy Renault

(57) ABSTRACT

An image is reproduced and transferred onto a substrate by (a) providing a positive electrode having a continuous passivated surface moving at constant speed; (b) forming on the positive electrode surface dots of colored, coagulated colloid representative of a desired image, by electrocoagulation of a colloid present in an electrocoagulation printing ink; and (c) bringing a substrate into contact with the dots of colloid to cause transfer of same onto the substrate. Step (b) is carried out by providing a series of negative electrodes having passivated surfaces spaced from the positive electrode surface by a constant gap; coating the positive electrode surface with an olefin; filling the electrode gap with the ink; applying to the negative electrodes a pulsed bias voltage; and applying to selected ones of the negative electrodes a trigger voltage sufficient to cause point-by-point selective coagulation and adherence of the colloid onto the olefin-coated positive electrode surface.

42 Claims, 3 Drawing Sheets

ELECTROCOAGULATION PRINTING METHOD AND APPARATUS PROVIDING ENHANCED IMAGE RESOLUTION

CROSS-REFERENCE TO RELATED APPLICATION

This application is a continuation-in-part of U.S. application Ser. No. 09/430,020 filed on Oct. 29, 1999 now U.S. Pat. No. 6,210,553.

BACKGROUND OF THE INVENTION

The present invention pertains to improvements in the field of electrocoagulation printing. More particularly, the invention relates to an electrocoagulation printing method and apparatus providing enhanced image resolution.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

The positive electrode which is used for electrocoagulation printing must be made of an electrolytically inert metal capable of releasing trivalent ions so that upon electrical energization of the negative electrodes, dissolution of the passive oxide film on such an electrode generates trivalent ions which then initiate coagulation of the colloid. Examples of suitable electrolytically inert metals include stainless steels, aluminium and tin.

As explained in Applicant's U.S. Pat. No. 5,750,593 of Mar. 12, 1998, the teaching of which is incorporated herein by reference, a breakdown of passive oxide films occurs in the presence of electrolyte anions, such as $Cl^-$, $Br^-$ and $I^-$, there being a gradual oxygen displacement from the passive film by the halide anions and a displacement of adsorbed oxygen from the metal surface by the halide anions. The velocity of passive film breakdown, once started, increases explosively in the presence of an applied electric field. There is thus formation of a soluble metal halide at the metal surface. In other words, a local dissolution of the passive oxide film occurs at the breakdown sites, which releases metal ions into the electrolyte solution. Where a positive electrode made of stainless steel or aluminium is utilized in Applicant's electrocoagulation printing method, dissolution of the passive oxide film on such an electrode generates $Fe^{3+}$ or $Al^{3+}$ ions. These trivalent ions then initiate coagulation of the colloid.

As also explained in Applicant's U.S. Pat. No. 4,895,629, the negative electrodes must be spaced from one another by a distance which is equal to or greater than the electrode gap in order to prevent the negative electrodes from undergoing edge corrosion. This considerably limits the resolution of the image printed by electrocoagulation so that an image resolution of more than about 200 lines per inch cannot be obtained.

Applicant has attempted to increase the image resolution while satisfying the above minimum distance between the negative electrodes by arranging the electrodes along two closely adjacent parallel rows with the negative electrodes of one row being staggered with respect to the negative electrodes of the other row. Upon electrical energization of these electrodes, Applicant has observed that there is a grouping between the dots of coagulated colloid formed opposite the electrode active surfaces of the energized electrodes of one row and those formed opposite the electrode active surfaces of the energized electrodes of the other row, resulting in dots having an elliptical configuration rather than the desired circular configuration.

In order to overcome the above drawbacks, Applicant has proposed in U.S. application Ser. No. 09/430,020, now U.S. Pat. No. 6,210,553, to utilize negative electrolytically inert electrodes each having a surface coated with a passive oxide film and to apply to these electrodes a bias voltage ranging from −1.5 to −2.5 volts. As indicated in the U.S. application, this allows the negative electrodes to be positioned closer to one another without undergoing edge corrosion, thereby permitting the distance between the electrodes to be smaller than the electrode gap. A trigger voltage can then be applied to selected ones of the negative electrodes to energize same and cause point-by-point selective coagulation and adherence of the colloid onto the olefin-coated positive electrode surface opposite the surfaces of the energized electrodes. As also explained in the U.S. patent, if the bias voltage is less than −1.5 volts, the passive oxide film of each negative electrode upon being energized dissolves into the ink, resulting in a release of metal ions and edge corrosion of the negative electrodes. On the other hand, if the bias voltage is higher than −2.5 volts, such a voltage is sufficient to trigger the electrocoagulation of the colloid present in the ink on the anode. Thus, by operating with a bias voltage of −1.5 to −2.5 volts and by positioning the negative electrodes sufficiently close to one another, an image resolution as high as 400 lines per inch, or more, can be obtained.

Applicant has observed that the application to the negative electrodes of the aforesaid bias voltage over a continuous period of time, although enabling the negative electrodes to be positioned closer to one another without undergoing edge corrosion, causes the formation of a gelatinous material which deposits onto the surfaces of the negative electrodes, thereby creating an electrical resistance which increases as the amount of deposited gelatinous material increases, leading to a complete blocking of the electrical signal. Applicant also noted the formation of an undesirable low-density blur on the electrocoagulation printed image.

SUMMARY OF THE INVENTION

It is therefore an object of the present invention to overcome the above drawbacks and to provide an improved electrocoagulation printing method and apparatus enabling one to increase the resolution of the image printed by electrocoagulation and to obtain an image resolution as high as 400 lines per inch, or more, without causing formation of the above gelatinous deposit and low-density blur.

According to one aspect of the invention, there is provided an electrocoagulation printing method comprising the steps of:

a) providing a positive electrolytically inert electrode having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto the substrate and thereby imprint the substrate with the image;

the improvement wherein step (b) is carried out by:

i) providing a series of negative electrolytically inert electrodes each having a surface covered with a passive oxide film, the negative electrodes being electrically insulated from one another and arranged in rectilinear alignment so that the surfaces thereof define a plurality of corresponding negative electrode active surfaces disposed in a plane spaced from the positive electrode active surface by a constant predetermined gap, the negative electrodes being spaced from one another by a distance smaller than the electrode gap;

ii) coating the positive electrode active surface with an olefinic substance to form on the surface micro-droplets of olefinic substance;

iii) filling the electrode gap with the aforesaid electrocoagulation printing ink;

iv) applying to the negative electrodes a pulsed bias voltage ranging from −1.5 to −40 volts and having a pulse duration of 15 nanoseconds to 6 microseconds, the bias voltage applied being inversely and non-linearly proportional to the pulse duration;

v) applying to selected ones of the negative electrodes a trigger voltage sufficient to energize same and cause point-by-point selective coagulation and adherence of the colloid onto the olefin-coated positive electrode active surface opposite the electrode active surfaces of the energized electrodes while the positive electrode active surface is moving, thereby forming the dots of colored, coagulated colloid; and vi) removing any remaining non-coagulated colloid from the positive electrode active surface.

According to another aspect of the invention, there is also provided an electrocoagulation printing apparatus comprising:

a positive electrolytically inert electrode having a continuous passivated surface defining a positive electrode active surface;

means for moving the positive electrode active surface at a substantially constant speed along a predetermined path;

means for forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and means for bringing a substrate into contact with the dots of colored, coagulated colloid to cause transfer of the colored, coagulated colloid from the positive electrode active surface onto the substrate and thereby imprint the substrate with the image;

the improvement wherein the means for forming the dots of colored, coagulated colloid comprise:

a series of negative electrolytically inert electrodes each having a surface covered with a passive oxide film, the negative electrodes being electrically insulated from one another and arranged in rectilinear alignment so that the surfaces thereof define a plurality of corresponding negative electrode active surfaces disposed in a plane spaced from the positive electrode active surface by a constant predetermined gap, the negative electrodes being spaced from one another by a distance smaller than the electrode gap;

means for coating the positive electrode active surface with an olefinic substance to form on the surface micro-droplets of olefinic substance;

means for filling the electrode gap with the electrocoagulation printing ink;

means for applying to the negative electrodes a pulsed bias voltage ranging from −1.5 to −40 volts and having a pulse duration of 15 nanoseconds to 6 microseconds, so that the bias voltage applied is inversely and non-linearly proportional to the pulse duration;

means for applying to selected ones of the negative electrodes a trigger voltage sufficient to energize same and cause point-by-point selective coagulation and adherence of the colloid onto the olefin-coated positive electrode active surface opposite the electrode active surfaces of the energized electrode while said positive electrode active surface is moving, thereby forming the dots of colored, coagulated colloid; and means for removing any remaining non-coagulated colloid from the positive electrode active surface.

Applicant has found quite unexpectedly that by applying to the negative electrodes a pulsed bias voltage ranging from −1.5 to −40 volts and having a pulse duration of 15 nanoseconds to 6 microseconds, in a manner such that the bias voltage applied is inversely and non-linearly proportional to the pulse duration, undesirable formation of the aforesaid gelatinous deposit and low-density blur is avoided. If the pulsed bias voltage is less than −1.5 volts at a pulse duration of 6 microseconds, the passive oxide film of each negative electrode upon being energized dissolves into the ink, resulting in a release of metal ions and edge corrosion of the negative electrodes. On the other hand, if the pulsed bias voltage is higher that −40 volts at a pulse duration of 15 nanoseconds, such a voltage is sufficient to cause formation of the gelatinous deposit and low-density blur. If the pulse duration is shorter than 15 nanoseconds, the negative electrodes undergo edge corrosion and, if it is longer than 6 microseconds, there is formation of the gelatinous deposit and of the low-density blur. The pulse duration must therefore be insufficient for the bias voltage to cause formation of the gelatinous deposit and the low-density blur, yet sufficient for the bias voltage to protect the negative electrodes against edge corrosion. Thus, by operating with a pulsed bias voltage ranging from −1.5 to −40 volts and having a pulse duration of 15 nanoseconds to 6 microseconds, preferably about −2 volts at a pulse duration of 4 microseconds, and by positioning the negative electrodes sufficiently close to one another with a spacing therebetween smaller than the electrode gap, an image resolution as high as 400 lines per inch, or more, can be obtained without adverse effect.

Preferably, the negative electrodes each have a cylindrical configuration with a circular cross-section and a diameter ranging from about 20 μm to about 50 μm Electrodes having a diameter of about 20 μm are preferred. The gap which is defined between the positive and negative electrodes can range from about 35 μm to about 100 μm, the smaller the electrode gap the sharper are the dots of coagulated colloid produced. Where the electrode gap is of the order of 50 μm, the negative electrodes are preferably spaced from one another by a distance of about 30 μm to about 40 μm. On the other hand, when the electrode gap is of the order of 35 μm, the negative electrodes are preferably spaced from one another by a distance of about 20 μm.

Examples of suitable electrolytically inert metals from which the negative electrodes can be made include chromium, nickel, stainless steel and titanium; stainless steel is particularly preferred. The positive electrode, on the other hand, can be made of stainless steel, aluminum or tin.

Coating of the positive electrode with an olefinic substance prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes. Applicant has found that it is no longer necessary to admix a metal oxide with the olefin substance; it is believed that the passive oxide film on currently available electrode contains sufficient metal oxide to act as catalyst for the desired reaction.

Examples of suitable olefinic substances which may be used to coat the surface of the positive electrode in step (b)(ii) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. Oleic acid is particularly preferred. The micro-droplets formed on the surface of the positive electrode active surface generally have a size ranging from about 1 to about 5 μm.

The olefin-coated positive active surface is preferably polished to increase the adherence of the micro-droplets onto the positive electrode active surface, prior to step (b)(ii). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the micro-droplets onto the positive electrode active surface.

Where a polychromic image is desired, steps (b) and (c) of the above electrocoagulation printing method are repeated several times to define a corresponding number of printing stages arranged at predetermined locations along the aforesaid path and each using a coloring agent of different color, and to thereby produce several differently colored images of coagulated colloid which are transferred at the respective transfer positions onto the substrate in superimposed relation to provide a polychromic image. It is also possible to repeat several times steps (a), (b) and (c) to define a corresponding number of printing stages arranged in tandem relation and each using a coloring agent of different color, and to thereby produce several differently colored images of coagulated colloid which are transferred at respective transfer positions onto the substrate in superimposed relation to provide a polychromic image, the substrate being in the form of a continuous web which is passed through the respective transfer positions for being imprinted with the colored images at the printing stages. Alternatively, the printing stages defined by repeating several times steps (a), (b) and (c) can be arranged around a single roller adapted to bring the substrate into contact with the dots of colored, coagulated colloid of each printing stage and the substrate which is in the form of a continuous web is partially wrapped around the roller and passed through the respective transfer positions for being imprinted with the colored images at the printing stages. The last two arrangements are described in U.S. Pat. No. 4,895,629.

When a polychromic image of high definition is desired, it is preferable to bring an endless non-extensible belt moving at substantially the same speed as the positive electrode active surface and having on one side thereof a colloid retaining surface adapted to releasably retain dots of electrocoagulated colloid, into contact with the positive electrode active surface to cause transfer of the differently colored images at the respective transfer positions onto the colloid retaining surface of such a belt in superimposed relation to provide a polychromic image, and thereafter bring the substrate into contact with the colloid retaining surface of the belt to cause transfer of the polychromic image from the colloid retaining surface onto the substrate and to thereby imprint the substrate with the polychromic image. As explained in Applicant's U.S. Pat. No. 5,908,541 of Jun. 1, 1999, the teaching of which is incorporated herein by reference, by utilizing an endless non-extensible belt having a colloid retaining surface such as a porous surface on which dots of colored, coagulated colloid can be transferred and by moving such a belt independently of the positive electrode, from one printing unit to another, so that the colloid retaining surface of the belt contacts the colored, coagulated colloid in sequence, it is possible to significantly improve the registration of the differently colored images upon their transfer onto the colloid retaining surface of the belt, thereby providing a polychromic image of high definition which can thereafter be transferred onto the paper web or other substrate. For example, use can be made of a belt comprising a plastic material having a porous coating of silica.

Accordingly, the present invention also provides, in a further aspect thereof, an improved multicolor electrocoagulation printing method comprising the steps of:

a) providing a positive electrolytically inert electrode having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent;

c) bringing an endless non-extensible belt moving at substantially the same speed as the positive electrode active surface and having on one side thereof a colloid retaining surface adapted to releasably retain dots of electroagulated colloid, into contact with the positive electrode active surface to cause transfer of the dots of colored, coagulated colloid from the positive electrode active surface onto the colloid retaining surface of the belt and to thereby imprint the colloid retaining surface with the image;

d) repeating steps (b) and (c) several times to define a corresponding number of printing stages arranged at predetermined locations along the path and each using a coloring agent of different color, to thereby produce several differently colored images of coagulated colloid which are transferred at respective transfer positions onto the colloid retaining surface in superimposed relation to provide a polychromic image; and e) bringing a substrate into contact with the colloid retaining surface of the belt to cause transfer of the polychromic image from the colloid retaining surface onto the substrate and to thereby imprint the substrate with the polychromic image;

the improvement wherein step (b) is carried out as defined above.

According to yet another aspect of the invention, there is provided an improved electrocoagulation printing apparatus comprising:

a positive electrolytically inert electrode having a continuous passivated surface defining a positive electrode active surface;

means for moving the positive electrode active surface at a substantially constant speed along a predetermined path;

an endless non-extensible belt having on one side thereof a colloid retaining surface adapted to releasably retain dots of electrocoagulated colloid;

means for moving the belt at substantially the same speed as the positive electrode active surface;

a plurality of printing units arranged at predetermined locations along the path, each printing unit comprising:

means for forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersion medium, a soluble electrolyte and a coloring agent, and means for bringing the belt into contact with the positive electrode active surface at a respective transfer station to cause transfer of the dots of colored, coagulated colloid from the positive electrode active surface onto the colloid retaining surface of the belt and to imprint the colloid retaining surface with the image, thereby producing several differently colored images of coagulated colloid which are transferred at the respective transfer stations onto the colloid retaining surface in superimposed relation to provide a polychromic image; and means for bringing a substrate into contact with the colloid retaining surface of the belt to cause transfer of the polychromic image from the colloid retaining surface onto the substrate and to thereby imprint the substrate with the polychromic image;

the improvement wherein the means for forming the dots of colored, coagulated colloid are as defined above.

The positive electrode used can be in the form of a moving endless belt as described in Applicant's U.S. Pat. No. 4,661,222, or in the form of a revolving cylinder as described in Applicant's U.S. Pat. Nos. 4,895,629 and 5,538,601, the teachings of which are incorporated herein by reference. In the latter case, the printing stages or units are arranged around the positive cylindrical electrode. Preferably, the positive electrode active surface and the ink are maintained at a temperature of about 35–60° C., preferably 40° C., to increase the viscosity of the coagulated colloid in step (b) so that the dots of colored, coagulated colloid remain coherent during their transfer in step (c), thereby enhancing transfer of the colored, coagulated colloid onto the substrate or belt. For example, the positive electrode active surface can be heated at the desired temperature and the ink applied on the heated electrode surface to cause a transfer of heat therefrom to the ink.

Where the positive cylindrical electrode extends vertically, step (b)(ii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a weight average molecular weight between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a weight average molecular weight of about 250,000 and sold by Cyanamid Inc. under the trade mark ACCOSTRENGTH 86. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. The coloring agent can be a dye or a pigment. Examples of suitable dyes which may be used to color the colloid are the water soluble dyes available from HOECHST such as Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the anionic dispersing agent sold by Boehme Filatex Canada Inc. under the trade mark CLOSPERSE 25000.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The optical density of the dots of colored, coagulated colloid may be varied by varying the voltage and/or pulse duration of the pulse-modulated signals applied to the negative electrodes.

After step (c), the positive electrode active surface is generally cleaned to remove therefrom any remaining coagulated colloid. According to a preferred embodiment, the positive electrode is rotatable in a predetermined direction and any remaining coagulated colloid is removed from the positive electrode active surface by providing an elongated rotatable brush extending parallel to the longitudinal axis of the positive electrode, the brush being provided with a plurality of radially extending bristles made of horsehair and having extremities contacting the positive electrode active surface, rotating the brush in a direction opposite to the direction of rotation of the positive electrode so as to cause the bristles to frictionally engage the positive electrode active surface, and directing jets of cleaning liquid under pressure against the positive electrode active surface, from either side of the brush. In such an embodiment, the positive electrode active surface and the ink are preferably maintained at a temperature of about 35–60° C. by heating the cleaning liquid to thereby heat the positive electrode active surface upon contacting same and applying the ink on the heated electrode surface to cause a transfer of heat therefrom to the ink.

Preferably, the electrocoagulation printing ink contains water as the dispersing medium and the dots of differently colored, coagulated colloid representative of the polychromic image are moistened between the aforementioned steps (d) and (e) so that the polychromic image is substantially completely transferred onto the substrate in step (e).

According to another preferred embodiment, the substrate is in the form of a continuous web and step (e) is carried out by providing a support roller and a pressure roller extending parallel to the support roller and pressed thereagainst to form a nip through which the belt is passed, the support roller and pressure roller being driven by the belt upon movement thereof, and guiding the web so as to pass through the nip between the pressure roller and the porous surface of the belt for imprinting the web with the polychromic image. Preferably, the belt with the porous surface thereof imprinted with the polychromic image is guided so as to travel along a path extending in a plane intersecting the longitudinal axis of the positive electrode at right angles, thereby exposing the porous surface to permit contacting thereof by the web. Where the longitudinal axis of the positive electrode extends vertically, the belt is preferably guided so as to travel along a horizontal path with the porous surface facing downwardly, the support roller and pressure roller having rotation axes disposed in a plane extending perpendicular to the horizontal path. Such an arrangement is described in the aforementioned U.S. Pat. No. 5,908,541.

After step (e), the porous surface of the belt is generally cleaned to remove therefrom any remaining coagulated colloid. According to a preferred embodiment, any remaining coagulated colloid is removed from the porous surface of the belt by providing at least one elongated rotatable brush disposed on the one side of the belt and at least one support roller extending parallel to the brush and disposed on the opposite side of the belt, the brush and support roller having rotation axes disposed in a plane extending perpendicular to the belt, the brush being provided with a plurality of radially extending bristles made of horsehair and having extremities contacting the porous surface, rotating the brush in a direction opposite to the direction of movement of the belt so as to cause the bristles to frictionally engage the porous surface while supporting the belt with the support roller, directing jets of cleaning liquid under pressure against the porous surface from either side of the brush and removing the cleaning liquid with any dislodged coagulated colloid from the porous surface.

BRIEF DESCRIPTION OF THE DRAWINGS

Further features and advantages of the invention will become more readily apparent from the description of preferred embodiments as illustrated by way of examples in the accompanying drawings, in which.

DESCRIPTION OF PREFERRED EMBODIMENTS

Figure 1:
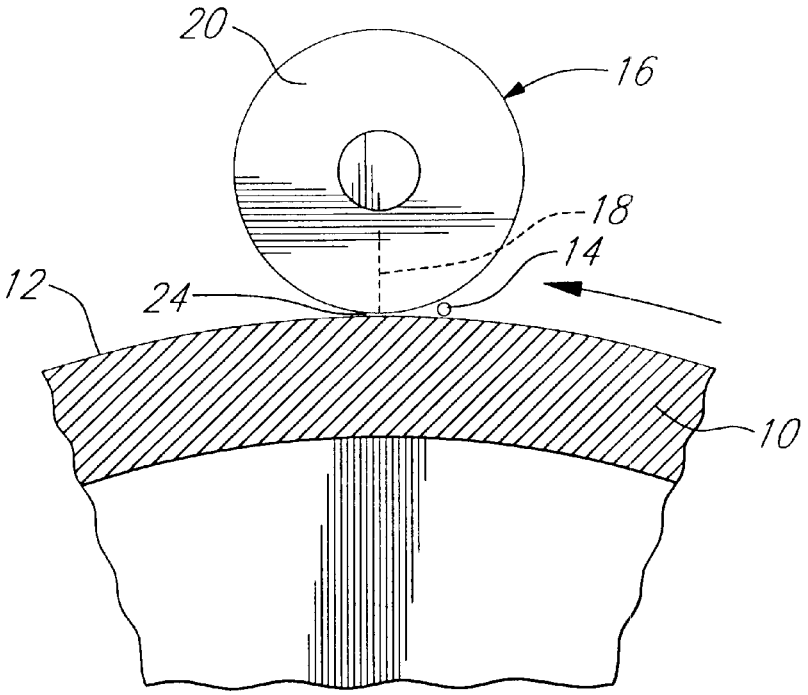
FIG. 1 is a fragmentary sectional view of an electrocoagulation printing apparatus according to a preferred embodiment of the invention, showing a printing head with a series of negative electrodes.
Figure 2:
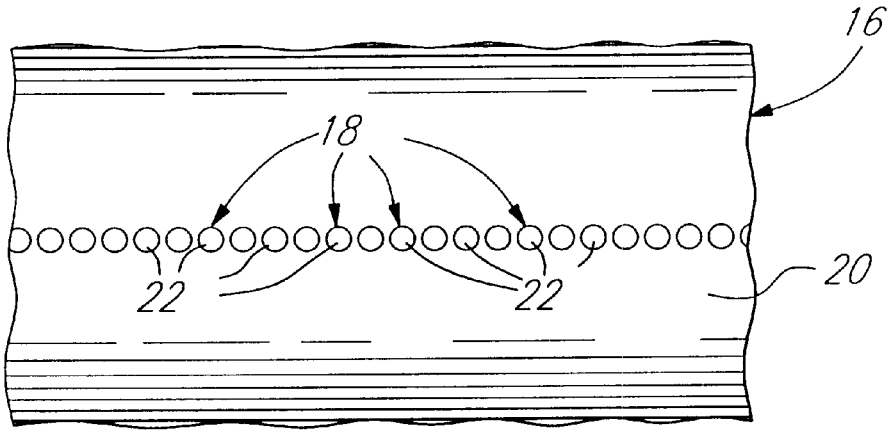
FIG. 2 is a fragmentary longitudinal view of the printing head illustrated in FIG. 1.

Referring first to FIG. 1, there is illustrated a positive electrode 10 in the form of a revolving cylinder and having a passivated surface 12 defining a positive electrode active surface adapted to be coated with an olefinic substance by means of a positive electrode coating device (not shown). A device 14 is provided for discharging an electrocoagulation printing ink onto the surface 12. The electrocoagulation printing ink consists of a colloidal dispersion containing an electrolytically coagulable colloid, a dispersing medium, a soluble electrolyte and a coloring agent. A printing head 16 having a series of negative electrodes 18 is used for electrocoagulating the colloid contained in the ink to form on positive electrode surface 12 dots of colored, coagulated colloid representative of a desired image. As shown in FIG. 2, the printing head 16 comprises a cylindrical electrode carrier 20 with the negative electrodes 18 being electrically insulated from one another and arranged in rectilinear alignment along the length of the electrode carrier 20 to define a plurality of corresponding negative active surfaces 22. The printing head 16 is positioned relative to the positive electrode 10 such that the surfaces 22 of the negative electrodes 18 are disposed in a plane which is spaced from the positive electrode surface 12 by a constant predetermined gap 24. The electrodes 18 are also spaced from one another by a distance smaller than the electrode gap 24 to increase image resolution. The device 14 is positioned adjacent the electrode gap 24 to fill same with the electrocoagulation printing ink.

Figure 3:
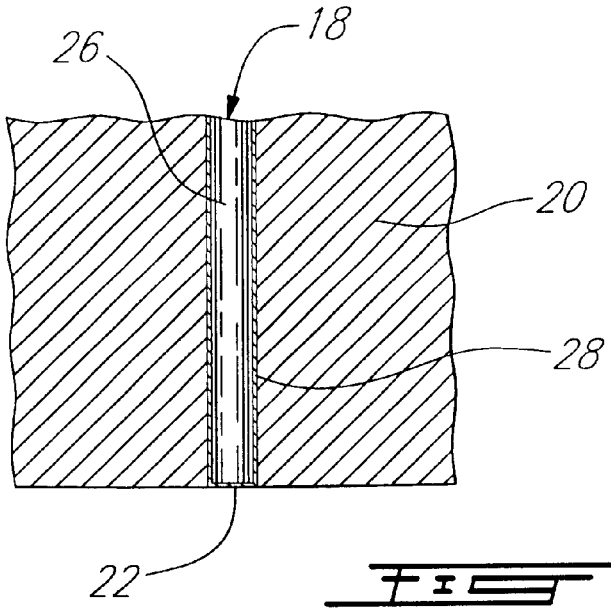
FIG. 3 is a fragmentary sectional view of one of the negative electrodes illustrated in FIG. 1.

As shown in FIG. 3, the negative electrodes 18 each have a cylindrical body 26 made of an electrolytically inert metal and covered with a passive oxide film 28. The end surface of the electrode body 26 covered with such a film defines the aforementioned negative electrode active surface 22.

Figure 4:
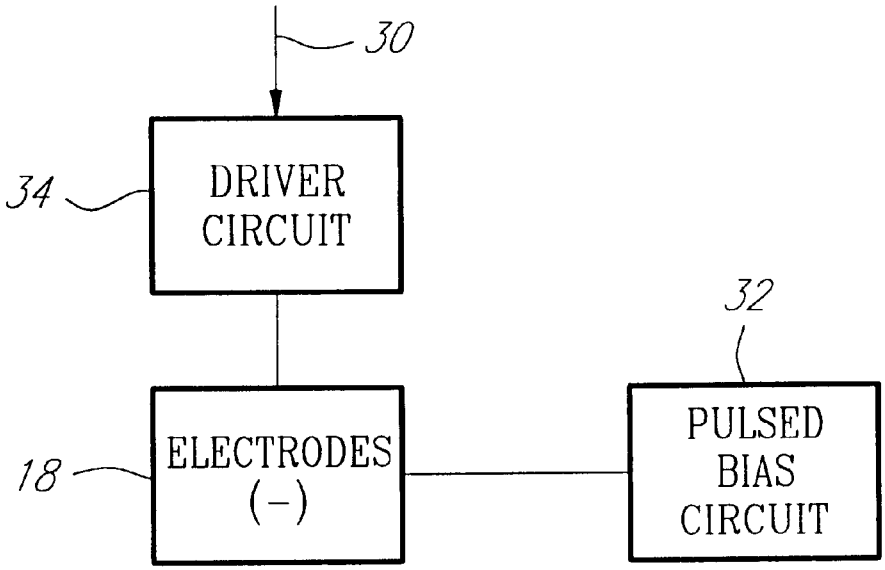
FIG. 4 is a schematic diagram showing how an input signal of information is processed to reproduce an image by electrocoagulation of a colloid.
Figure 5:
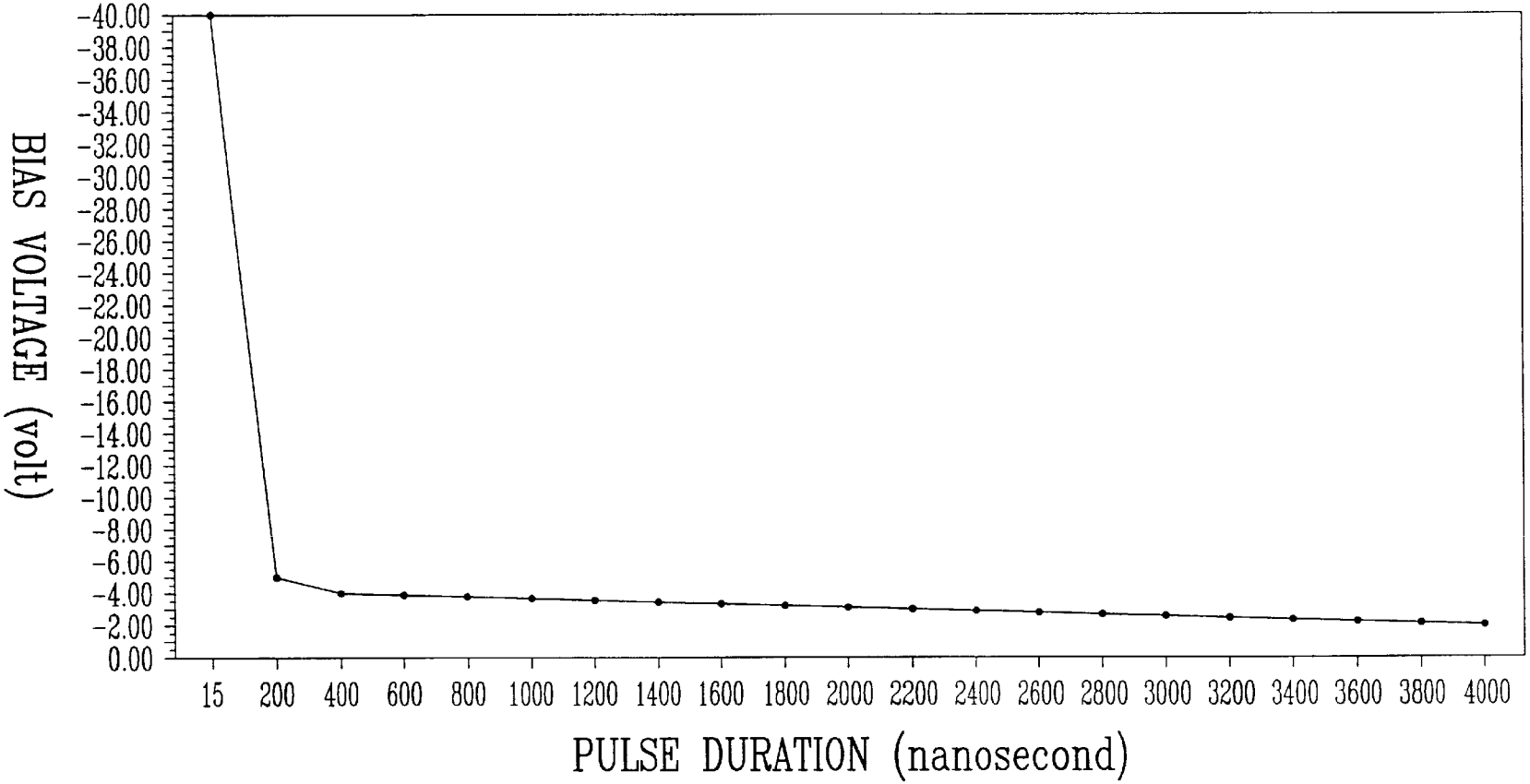
FIG. 5 is a graph showing the relationship between the pulsed bias voltage applied to the negative electrodes and the pulse duration.

FIG. 4 is a schematic diagram illustrating how the negative electrodes 18 are energized in response to an input signal of information 30 to form dots of colored, coagulated colloid representative of a desired image. A pulsed bias circuit 32 is provided for applying to the negative electrodes 18 a pulsed bias voltage ranging from −1.5 to −40 volts and having a pulse duration of 15 nanoseconds to 6 microseconds. A driver circuit 34 is also used for addressing selected ones of the electrodes 18 so as to apply a trigger voltage to the selected electrodes and energize same. Such an electrical energizing causes point-by-point selective coagulation and adherence of the colloid onto the olefin-coated surface 12 of the positive electrode 10 opposite the electrode active surfaces 22 while the electrode 10 is rotating, thereby forming on the surface 12 a series of corresponding dots of colored, coagulated colloid. As shown in FIG. 5, the pulsed bias voltage applied by the circuit 32 to the negative electrodes 18 is inversely and non-linearly proportional to the pulse duration.

A pulsed bias voltage within the above range ensures that there is no dissolution of the passive oxide film 28 into the ink and that there is no formation of the aforementioned gelatinous deposit and low-density blur. Such a bias voltage also enables the electrodes 18 to be spaced from one another by a distance which is smaller than the electrode gap 24, thereby providing an image resolution as high as 400 lines per inch, or more.

When it is desired to reproduce a polychromic image, use is preferably made of a central processing unit (CPU) for controlling the driver circuit associated with each color printing unit.

We claim:

1. In an electrocoagulation printing method comprising the steps of:

a) providing a positive electrolytically inert electrode having a continuous passivated surface moving at substantially constant speed along a predetermined path, said passivated surface defining a positive electrode active surface;

b) forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto said substrate and thereby imprint said substrate with said image;

the improvement wherein step (b) is carried out by:

i) providing a series of negative electrolytically inert electrodes each having a surface covered with a passive oxide film, said negative electrodes being electrically insulated from one another and arranged in rectilinear alignment so that the surfaces thereof define a plurality of corresponding negative electrode active surfaces disposed in a plane spaced from said positive electrode active surface by a constant predetermined gap, said negative electrodes being spaced from one another by a distance smaller than said electrode gap;

ii) coating said positive electrode active surface with an olefinic substance to form on the surface microdroplets of olefinic substance;

iii) filling the electrode gap with said electrocoagulation printing ink;

iv) applying to the negative electrodes a pulsed bias voltage ranging from −1.5 to −40 volts and having a pulse duration of 15 nanoseconds to 6 microseconds, the bias voltage applied being inversely and non-linearly proportional to the pulse duration;

v) applying to selected ones of said negative electrodes a trigger voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming said dots of colored, coagulated colloid; and vi) removing any remaining non-coagulated colloid from said positive electrode active surface.

2. A method as claimed in claim 1, wherein a pulsed bias voltage of about −2 volts with a pulse duration of 4 microseconds is applied to said negative electrodes.

3. A method as claimed in claim 1, wherein said negative electrodes each have a cylindrical configuration with a circular cross-section and a diameter ranging from about 20 to about 50 $\mu$m.

4. A method as claimed in claim 3, wherein said negative electrodes each have a diameter of about 20 $\mu$m.

5. A method as claimed in claim 3, wherein said electrode gap ranges from about 35 to about 100 $\mu$m.

6. A method as claimed in claim 5, wherein said electrode gap is about 50 $\mu$m and wherein said negative electrodes are spaced from one another by a distance of about 30 to 40 $\mu$m.

7. A method as claimed in claim 5, wherein said electrode gap is about 35 $\mu$m and wherein said negative electrodes are spaced from one another by a distance of about 20 $\mu$m.

8. A method as claimed in claim 1, wherein said negative electrodes are formed of an electrolytically inert metal selected from the group consisting of chromium, nickel, stainless steel and titanium.

9. A method as claimed in claim 8, wherein said electrolytically inert metal comprises stainless steel.

10. A method as claimed in claim 1, wherein steps (b) and (c) are repeated several times to define a corresponding number of printing stages arranged at predetermined locations along said path and each using a coloring agent of different color, to thereby produce several differently colored images of coagulated colloid which are transferred at respective transfer positions onto said substrate in superimposed relation to provide a polychromic image.

11. A method as claimed in claim 10, wherein said positive electrode is a cylindrical electrode having a central longitudinal axis and rotating at substantially constant speed about said longitudinal axis, and wherein said printing stages are arranged around said positive cylindrical electrode.

12. In a multicolor electrocoagulation printing method comprising the steps of:

a) providing a positive electrolytically inert electrode having a continuous passivated surface moving at substantially constant speed along a predetermined path, said passivated surface defining a positive electrode active surface;

b) forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent;

c) bringing an endless non-extensible belt moving at substantially the same speed as the positive electrode active surface and having on one side thereof a colloid retaining surface adapted to releasably retain dots of electrocoagulated colloid, into contact with the positive electrode active surface to cause transfer of the dots of colored, coagulated colloid from the positive electrode active surface onto the colloid retaining surface of the belt and to thereby imprint the colloid retaining surface with the image;

d) repeating steps (b) and (c) several times to define a corresponding number of printing stages arranged at predetermined locations along said path and each using a coloring agent of different color, to thereby produce several differently colored images of coagulated colloid which are transferred at respective transfer positions onto said colloid retaining surface in superimposed relation to provide a polychromic image; and e) bringing a substrate into contact with the colloid retaining surface of said belt to cause transfer of the polychromic image from said colloid retaining surface onto said substrate and to thereby imprint said substrate with said polychromic image;

the improvement wherein step (b) is carried out by:

i) providing a series of negative electrolytically inert electrodes each having a surface covered with a passive oxide film, said negative electrodes being electrically insulated from one another and arranged in rectilinear alignment so that the surfaces thereof define a plurality of corresponding negative electrode active surfaces disposed in a plane spaced from said positive electrode active surface by a constant predetermined gap, said negative electrodes being spaced from one another by a distance smaller than said electrode gap;

ii) coating said positive electrode active surface with an olefinic substance to form on the surface microdroplets of olefinic substance;

iii) filling the electrode gap with said electrocoagulation printing ink;

iv) applying to the negative electrodes a pulsed bias voltage ranging from −1.5 to −40 volts and having a pulse duration of 15 nanoseconds to 6 microseconds, the bias voltage applied being inversely and nonlinearly proportional to the pulse duration;

v) applying to selected ones of said negative electrodes a trigger voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming said dots of colored, coagulated colloid; and vi) removing any remaining non-coagulated colloid from said positive electrode active surface.

13. A method as claimed in claim 12, wherein a pulsed bias voltage of about −2 volts with a pulse duration of 4 microseconds is applied to said negative electrodes.

14. A method as claimed in claim 12, wherein the negative electrodes each have a cylindrical configuration with a circular cross-section and a diameter ranging from about 20 to about 50 $\mu$m.

15. A method as claimed in claim 14, wherein said negative electrode each have a diameter of about 20 $\mu$m.

16. A method as claimed in claim 14, wherein said electrode gap ranges from about 35 to about 100 $\mu$m.

17. A method as claimed in claim 16, wherein said electrode gap is about 50 $\mu$m and wherein said negative electrodes are spaced from one another by a distance of about 30 to 40 $\mu$m.

18. A method as claimed in claim 16, wherein said electrode gap is about 35 $\mu$m and wherein said negative electrodes are spaced from one another by a distance of about 20 $\mu$m.

19. A method as claimed in claim 12, wherein said negative electrodes are formed of an electrolytically inert metal selected from the group consisting of chromium, nickel, stainless steel and titanium.

20. A method as claimed in claim 19, wherein said electrolytically inert metal comprises stainless steel.

21. A method as claimed in claim 12, wherein said positive electrode is a cylindrical electrode having a central longitudinal axis and rotating at substantially constant speed about said longitudinal axis, and wherein said printing stages are arranged around said positive cylindrical electrode.

22. In an electrocoagulation printing apparatus comprising:

a positive electrolytically inert electrode having a continuous passivated surface defining a positive electrode active surface;

means for moving said positive electrode active surface at a substantially constant speed along a predetermined path;

means for forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and means for bringing a substrate into contact with the dots of colored, coagulated colloid to cause transfer of the colored, coagulated colloid from the positive electrode active surface onto said substrate and thereby imprint said substrate with said image;

the improvement wherein said means for forming said dots of colored, coagulated colloid comprise:

a series of negative electrolytically inert electrodes each having a surface covered with a passive oxide film, said negative electrodes being electrically insulated from one another and arranged in rectilinear alignment so that the surfaces thereof define a plurality of corresponding negative electrode active surfaces disposed in a plane spaced from said positive electrode active surface by a constant predetermined gap, said negative electrodes being spaced from one another by a distance smaller than said electrode gap;

means for coating said positive electrode active surface with an olefinic substance to form on the surface micro-droplets of olefinic substance;

means for filling the electrode gap with said electrocoagulation printing ink;

means for applying to said negative electrodes a pulsed bias voltage ranging from −1.5 to −40 volts and having a pulse duration of 15 nanoseconds to 6 microseconds, so that the bias voltage applied is inversely and non-linearly proportional to the pulse duration;

means for applying to selected ones of said negative electrodes a trigger voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming said dots of colored, coagulated colloid; and means for removing any remaining non-coagulated colloid from said positive electrode active surface.

23. An apparatus as claimed in claim 22, wherein said negative electrodes each have a cylindrical configuration with a circular cross-section and a diameter ranging from about 20 to about 50 μm.

24. An apparatus as claimed in claim 23, wherein said negative electrodes each have a diameter of about 20 μm.

25. An apparatus as claimed in claim 23, wherein said electrode gap ranges from about 35 to about 100 μm.

26. An apparatus as claimed in claim 25, wherein said electrode gap is about 50 μm and wherein said negative electrodes are spaced from one another by a distance of about 30 to 40 μm.

27. An apparatus as claimed in claim 25, wherein said electrode gap is about 35 μm and wherein said negative electrodes are spaced from one another by a distance of about 20 μm.

28. An apparatus as claimed in claim 22, wherein said negative electrodes are formed of an electrolytically inert metal selected from the group consisting of chromium, nickel, stainless steel and titanium.

29. An apparatus as claimed in claim 28, wherein said electrolytically inert metal comprises stainless steel.

30. An apparatus as claimed in claim 22, wherein said means for applying said trigger voltage to selected ones of said negative electrodes comprises driver circuit means for addressing selected ones of said negative electrodes so as to apply said trigger voltage to the selected negative electrodes.

31. An apparatus as claimed in claim 22, wherein said means for forming said dots of colored, coagulated colloid and said means for bringing said substance into contact with said dots of colored, coagulated colloid are arranged to define a printing unit, and wherein there are several printing units positioned at predetermined locations along said path and each using a coloring agent of different colored for producing several differently transferred at respective transfer stations onto said substrate in superimposed relation to provide a polychromic image.

32. An apparatus as claimed in claim 31, wherein said positive electrode is a cylindrical electrode having a central longitudinal axis and wherein said means for moving said positive electrode active surface includes means for rotating said positive cylindrical electrode about said longitudinal axis, and wherein said printing units being arranged around said positive cylindrical electrode.

33. In a multicolor electrocoagulation printing apparatus comprising:

a positive electrolytically inert electrode having a continuous passivated surface defining a positive electrode active surface;

means for moving said positive electrode active surface at a substantially constant speed along a predetermined path;

an endless non-extensible belt having on one side thereof a colloid retaining surface adapted to releasably retain dots of electrocoagulated colloid;

means for moving said belt at substantially the same speed as said positive electrode active surface;

a plurality of printing units arranged at predetermined locations along said path, each printing unit comprising:

means for forming on said positive electrode active surface a plurality of dots of colored, coagulated colloid representative of a desired image, by electrocoagulated of an electrolytically coagulable colloid present in an electrocoagulation printing ink comprising a liquid colloidal dispersion containing said electrolytically coagulable colloid, a dispersion medium, a soluble electrolyte and a coloring agent, and means for bringing said belt into contact with said positive electrode active surface at a respective transfer station to cause transfer of the dots of colored, coagulated colloid from the positive electrode active surface onto the colloid retaining surface of said belt and to imprint said colloid retaining surface with the image, thereby producing several differently colored images of coagulated colloid which are transferred at said respective transfer stations onto said colloid retaining surface in superimposed relation to provide a polychromic image; and means for bringing a substrate into contact with the colloid retaining surface of said belt to cause transfer of the polychromic image from said colloid retaining surface onto said substrate and to thereby imprint said substrate with said polychromic image;

the improvement wherein said means for forming said dots of colored, coagulated colloid comprise:

a series of negative electrolytically inert electrodes each having a surface covered with a passive oxide film, said negative electrodes being electrically insulated from one another and arranged in rectilinear alignment so that the surfaces thereof define a plurality of corresponding negative electrode active surfaces disposed in a plane spaced from said positive electrode active surface by a constant predetermined gap, said negative electrodes being spaced from one another by a distance smaller than said electrode gap;

means for coating said positive electrode active surface with an olefinic substance to form on the surface micro-droplets of olefinic substance;

means for filling the electrode gap with said electrocoagulation printing ink;

means for applying to said negative electrodes a pulsed bias voltage ranging from −1.5 to −40 volts and having a pulse duration of 15 nanoseconds to 6 microseconds, so that the bias voltage applied is inversely and non-linearly proportional to the pulse duration;

means for applying to selected ones of said negative electrodes a trigger voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming said dots of colored, coagulated colloid; and means for removing any remaining non-coagulated colloid from said positive electrode active surface.

34. An apparatus as claimed in claim 33, wherein said negative electrodes each have a cylindrical configuration with a circular cross-section and a diameter ranging from about 20 to about 50 $\mu$m.

35. An apparatus as claimed in claim 34, wherein said negative electrodes each have a diameter of about 20 $\mu$m.

36. An apparatus as claimed in claim 34, wherein said electrode gap ranges from about 35 to about 100 $\mu$m.

37. An apparatus as claimed in claim 36, wherein said electrode gap is about 50 $\mu$m and wherein said negative electrodes are spaced from one another by a distance of about 30 to 40 $\mu$m.

38. An apparatus as claimed in claim 36, wherein said electrode gap is about 35 $\mu$m and wherein said negative electrodes are spaced from one another by a distance of about 20 $\mu$m.

39. An apparatus as claimed in claim 33, wherein said negative electrodes are formed of an electrolytically inert metal selected from the group consisting of chromium, nickel, stainless steel and titanium.

40. An apparatus as claimed in claim 39, wherein said electrolytically inert metal comprises stainless steel.

41. An apparatus as claimed in claim 33, wherein said means for applying said trigger voltage to selected ones of said negative electrodes comprises driver circuit means for addressing selected ones of said negative electrodes so as to apply said trigger voltage to the selected negative electrodes.

42. An apparatus as claimed in claim 33, wherein said positive electrode is a cylindrical electrode having a central longitudinal axis and wherein said means for moving said positive electrode active surface includes means for rotating said positive cylindrical electrode about said longitudinal axis, said printing units being arranged around said positive cylindrical electrode.

* * * * *